US007921856B2

(12) United States Patent
Bilivitin et al.

(10) Patent No.: US 7,921,856 B2
(45) Date of Patent: Apr. 12, 2011

(54) SLEEVE FOR A RUSSIAN CIGARETTE

(76) Inventors: Yuriy Sergeyevich Bilivitin, Donetsk (UA); Oleg Anatoliyevich Grinevskyy, Donetsk (UA)

( * ) Notice: Subject to any disclaimer, the term of this patent is extended or adjusted under 35 U.S.C. 154(b) by 987 days.

(21) Appl. No.: 10/587,600

(22) PCT Filed: Feb. 3, 2005

(86) PCT No.: PCT/UA2005/000005

§ 371 (c)(1),
(2), (4) Date: Aug. 2, 2006

(87) PCT Pub. No.: WO2005/074696

PCT Pub. Date: Aug. 18, 2005

(65) Prior Publication Data

US 2007/0119466 A1 May 31, 2007

(30) Foreign Application Priority Data

| | | |
|---|---|---|
| Feb. 4, 2004 | (UA) | 2004020795 |
| Apr. 2, 2004 | (UA) | 2004042458 |
| Apr. 2, 2004 | (UA) | 2004042459 |
| May 26, 2004 | (UA) | 20040504021 |
| Jul. 21, 2004 | (UA) | 20040706048 |
| Jul. 26, 2004 | (UA) | 20040706169 |

(51) Int. Cl.
*A24B 1/00* (2006.01)

(52) U.S. Cl. ..... 131/360; 131/330; 131/191

(58) Field of Classification Search ..... None
See application file for complete search history.

(56) References Cited

U.S. PATENT DOCUMENTS 2,542,612 A * 2/1951 Arneson ..... 131/187

(Continued)

FOREIGN PATENT DOCUMENTS

DE 35 18831 A1 1/1986

(Continued)

OTHER PUBLICATIONS

English language translation from EPO website of DE 10044771 A1.*

(Continued)

*Primary Examiner* — Richard Crispino
*Assistant Examiner* — Michael J Felton
(74) *Attorney, Agent, or Firm* — Pauley Petersen & Erickson

(57) ABSTRACT

A cigarette casing for independent making of a Russian cigarette by a smoker or for bulk production. The casing of the Russian cigarette has an empty mouthpiece and a connected empty envelope and at least a part of the cavity of which is intended for the allocation of the smoking material. It contains a separating partition selectively penetrable for the smoke, installed so that at least a part of the cavity of the mouthpiece could be detached from at least a part of the cavity of the envelope, and so that it is possible to overlap at least a part of a cross section of the cavity of the mouthpiece. Its design impedes minor changes in the composition of the smoke, the penetration of the particles of the smoking material located in the cavity of the envelope into the cavity of the mouthpiece while filling the casing with the smoking material and into the mouth of the smoker during smoking. The casing of the Russian cigarette has an empty mouthpiece and a connected empty envelope, and the length of the mouthpiece is not less than the length of the envelope. The envelope overlaps the mouthpiece with all its length. The mouthpiece and the envelope are installed so that it is possible to move them relative to each other along a common longitudinal axis. The mouthpiece impedes the deformation of the part of the cavity of the envelope intended for the allocation of the smoking material before the placing of this smoking material.

11 Claims, 5 Drawing Sheets

U.S. PATENT DOCUMENTS 6,718,987 B1 4/2004 Pogossian et al.

FOREIGN PATENT DOCUMENTS

| | | | | |
|---|---|---|---|---|
| DE | 4107025 | A1 | * | 9/1992 |
| DE | 299 16 020 | U1 | | 12/1999 |
| DE | 10044771 | A1 | * | 4/2001 |
| EP | 1 093 728 | A1 | | 4/2001 |
| EP | 1 128 740 | A1 | | 9/2001 |
| EP | 1 163 857 | A1 | | 12/2001 |
| EP | 1 374 705 | A1 | | 1/2004 |
| EP | 1 378 182 | A1 | | 1/2004 |
| EP | 1 397 054 | A1 | | 3/2004 |
| GB | 805 693 | A | | 12/1958 |
| GB | 1 165 478 | A | | 10/1969 |
| GB | 2 347 607 | A | | 9/2000 |
| WO | WO 99/65343 | | | 12/1999 |
| WO | WO 02/09541 | A1 | | 2/2002 |

OTHER PUBLICATIONS

English language translation from EPO website of DE 10044771 A1 (Accessed Jun. 15, 2009).*

* cited by examiner

SLEEVE FOR A RUSSIAN CIGARETTE

BACKGROUND OF THE INVENTION

1. Field of the Invention

This invention relates to a casing intended for independent making of a cigarette or the like, such as a smoking combination by a smoker or for bulk production.

2. Discussion of Related Art

It is generally known that while smoking the consumer inhales the smoke of the smoking material. Smoke is a gas-dispersed system, aerosol, formed by the gaseous medium and particulate matters and liquid particles, suspended in it, which are the result of incomplete burning of smoking material.

The smoking material smoulders at constant pressure. During inhalation, the smoker creates a low-pressure zone at the place of smoke extraction in his or her mouth. As a result of the pressure differential, the flow of smoke exhibits laminar flow characteristics directed to the place of its extraction by the consumer.

The combustion products or fumes of the materials being smoked contain significant amounts of chemical elements and their compounds which are harmful to the human body.

A number of different filters aimed at the reduction of the chemical concentration in the smoke are known. For this purpose, porous material having high sorption properties expressed in high sorption activity and high sorption capacity are used in the filters. These filters are able to sorb a significant part of the above harmful components of the smoke, such as taught by British Patent Reference GB2347607.

High sorption properties of the tobacco products and accessories are reached by the usage of the reagents such as taught by European Patent Reference EP1128740, and the different devices such as taught by PCT International Application WO0209541, which have abilities to neutralize some harmful components of the fume.

However, a considerable number of consumers smoke, wishing to obtain smoke with its original taste and flavor, consequently with regular composition.

Among them there is an individual category of consumers giving preference to the independent choice of filling materials, including tobacco blends and very often by cocktails of different tobacco blends.

A second category of consumers is forced against their normal inclinations, to resort to inhalations of the combustion products of different smoking blends for the purposes of medication and disease-prevention. It is necessary to maintain the smoke composition for these consumers.

There are filters intended for maintenance of the original taste and flavor of the tobacco by ensuring the specified ratio of the filtered and unfiltered smoke, such as taught by European Patent Reference EP1093728.

It is apparent that any filter essentially changes the composition and thus the taste and flavor of the smoke.

In spite of the fact that the sorption capability is a property of any body, it is possible to achieve the maximum preservation of the composition, taste and flavor of the smoke by omitting such filters, reagents and devices.

There are many ways and products which make it possible for smokers to inhale the unfiltered smoke. However, each of them has certain imperfections along with the advantages.

Cigars and cigarillos are rather expensive and contain an amount of the smoking material significantly exceeding the proportions of the standard cigarettes and may lead to the increase of their consumption.

When smoking filterless cigarettes, the smoker extracts the smoke immediately from the smoking part which is why particles of the combustion products can get into the mouth of a smoker. The increasing temperature of the outer surface of such a cigarette does not allow complete smoking of the portion of the smoking material. It reduces the smoking comfort and increases the losses of the smoking material in wasted cigarette stubs, even when using cigarette holders or standard sheets of perforated cigarette paper, such as taught by European Patent Reference EP1378182.

In addition, many prepared tobacco products restrict the consumer in selection of the smoking material or force him or her to unnecessarily pay for the unused contents when such contents are thrown away.

Consumption of the combustion products of a smoking mixture by tobacco pipes corresponds to the existing preferences and necessity. However, pipes are also rather expensive and are intended for repeated use and thus they require proper care.

Some problems are solved by using cigarettes rolled by the smoker. However, these cigarettes have all the disadvantages of the filterless cigarettes. Besides, rolling of the cigarettes by the smoker is a rather time-consuming, laborious process requiring certain skills. Even though there are known mechanical devices, such as disclosed in European Patent Reference EP1374705 or EP1397054 which noticeably facilitate this process, they do not solve all the problems.

So called Russian cigarettes are used along with or in addition to the abovementioned methods for the purpose of consumption of the unfiltered fumes or combustion products of smoking materials.

It is common knowledge that the Russian cigarette is one variety of tobacco product and comprises a casing incorporating a portion of the smoking material. The mouthpiece of the Russian cigarette includes an empty mouthpiece and an empty envelope. The mouthpiece is a pipe made of rather heavyweight mouthpiece paper. The envelope is a pipe made of cigarette paper. It is linked to the mouthpiece overlapping it along the full length or part of its length or by a connection element. The empty part of the envelope standing out of the borders of the mouthpiece and connected to the cavity of the mouthpiece, intended for the allocation of the smoking material, forms the smoking part of the casing of the Russian cigarette. It is possible to install a filter inside the mouthpiece. The fumes of the smoking material coming out of the smoking part pass through the cavity of the mouthpiece and are extracted by the smoker from that end of the mouthpiece, which is more distant from the portion of the smoking material.

The Russian cigarette has the following standard dimensions: a diameter from 4 to 6 mm, a length from 70 to 105 mm, including the length of the mouthpiece from 40 to 70 mm, and a length of the smoking part is from 30 to 35 mm.

Russian cigarettes offer the following obvious advantages as compared with the other of the methods and devices for the consumption of unfiltered smoke.

In the first place, this disposable product is cheap and maintenance-free.

In the second place, the standard Russian cigarette has a portion of the smoking material compatible to the same portion contained in the standard cigarette and does not provoke increase of the consumption of the smoking material.

In the third place, the smoker extracts the fumes out of the end of the empty mouthpiece that is discontiguous to the smoking part. The significant length of the mouthpiece favors the cooling of the smoke. Thus, the mouthpiece gets heated only slightly. It increases the comfort of fume extraction by the smoker and allows smoking of the portion of the smoking material while completely avoiding its wasted losses.

Tobacco and non-tobacco blends are used in the Russian cigarettes, as a smoking material.

In spite of the available advantages, the industrial production of Russian cigarettes and application of their casings for the home-made cigarettes is restricted. It is caused by several significant deficiencies.

First, while making the Russian cigarettes it is difficult to prevent the particles of the smoking material from passing out of the smoking part into the cavity of the mouthpiece and consequently into the mouth of the smoker during smoking.

This is the reason why in extensive manufacturing, the smoking part of the mouthpiece of a Russian cigarette is filled with the smoking material pressed in the form of a compact rod. In addition, in order to prevent portions of the smoking material into the cavity of the mouthpiece, grooves with the teeth turned back into the cavity of the cigarette holder, for example as taught by a cigarette manufacturer in German Patent Reference DE3518831, can be made on the inner wall of the mouthpiece of the Russian cigarette.

However, while filling, storing, transporting and using the Russian cigarettes, the pressed smoking material becomes loosened. Regardless of the presence of the teeth, the particles of the smoking material escape from the smoking part into the cavity of the mouthpiece and later on into the mouth of the smoker, during smoking.

It is problematic for a smoker to make a Russian cigarette using such a casing because the non-pressed smoking material gets spilled through the wide cavity of the mouthpiece.

Installation of a filter in the cavity of the mouthpiece of a Russian cigarette or application of the filtering mouthpiece, such as taught by European Patent Reference EP1163857, almost excludes the possibility of getting the particles of the smoking material into the cavity of the mouthpiece and into the mouth of the smoker, during smoking. However, this is not acceptable for some consumers.

Second, the envelope of a Russian cigarette is made of cigarette paper which is a soft, yielding material. Thus there exists the problem of the smoking part of the casing of the Russian cigarette being subject to deformation before the smoking material is placed in it. Deformation of the part of the envelope intended for placing the smoking material hinders the filling of the casing of a Russian cigarette with the smoking material reducing the comfort of the consumer.

SUMMARY OF THE INVENTION

One object of this invention is to provide a casing of a Russian cigarette or like smoking device, whose design impedes, without making significant changes in the composition of the smoke, the penetration of the particles of the smoking material located in the smoking part, into the cavity of the mouthpiece while filling the casing with this smoking material, and into the mouth of a smoker, during smoking. A second object of this invention is to provide a casing of a Russian cigarette whose design impedes the deformation of the part of the envelope intended for the allocation of the smoking material before placing this smoking material.

In one embodiment of this invention, the casing of a Russian cigarette has an empty mouthpiece and an empty envelope connected to it, at least a part of the cavity of which is intended for the allocation of the smoking material. A separating partition is selectively penetrable by the smoke and installed so that it is possible to separate at least a part of the cavity of the mouthpiece from at least a part of the cavity of the casing intended for the allocation of the smoking material, as well as to overlap at least a part of the cross section of the cavity of the mouthpiece.

The pressed or non-pressed smoking material is located in the part of the cavity of the envelope of the casing of a Russian cigarette intended for it. Thus, the separating partition is selectively penetrable for the smoke and installed so that it is possible to detach at least a part of the cavity of the mouthpiece from at least a part of the cavity of the envelope intended for the allocation of the smoking material, and so that it is possible to overlap at least a part of the cross section of the cavity of the mouthpiece that impedes the penetration of the particles of the smoking material from the cavity of the envelope into the cavity of the mouthpieces.

While smoking a Russian cigarette, the separating partition is selectively penetrable by the smoke, and ensures penetration of the smoke from the cavity of the envelope intended for receiving the smoking material into the cavity of the mouthpiece.

At the same time, the separating partition is selectively penetrable by the smoke, and is installed so that it is possible to separate at least a part of the cavity of the mouthpiece from at least a part of the cavity of the envelope intended for the allocation of the smoking material, as well as to overlap at least a part of the cross section of the cavity of the mouthpiece. This prevents the penetration of the particles of the smoking materials from the cavity of the envelope intended for the allocation of the smoking material into the cavity of the mouthpiece and the mouth of the smoker.

One object of this invention is achieved by managing the generally known information about the physical and chemical composition of the fumes of the smoking materials, its physical and chemical properties and physical and chemical properties of the materials used for the production of the casing of a Russian cigarette.

The separating partition is selectively penetrable for the smoke and the possibilities of its installation ensure the availability of the holes with the dimensions sufficient for the free passing of the gaseous medium of the smoke and particles suspended in it from the cavity of the envelope intended for allocation of the smoking material into the cavity of the mouthpiece.

A certain quantity of the smoke components is sorbed by the partition as a result of the natural processes of the Brownian motion, sedimentation, coagulation, capillary condensation, etc. However, absence of the filter, made of the material having high sorption properties, special reagents and devices for neutralization of fume components, ensure minor changes of the composition of the fume of the smoking material.

Absence of the filter manufactured out of the material having high sorption capability and without application of the reagents increasing this capability, ensures insignificant sorbing of the smoke components by the separating partition.

The separating partition is selectively penetrable by the smoke, and prevents the particles of the smoking material from migrating from the cavity of the envelope into the cavity of the mouthpiece.

As a result of the natural processes, the internal surface of the empty mouthpiece also sorbs some amount of the smoke components. The mouthpieces, made of a material with a sorption capability which is not so high, without application of the reagents increasing this capability, ensures availability of the smoke with insignificantly changed composition and consequently taste and flavor by the consumer.

The above separating partition is selectively penetrable by the smoke and can be made in the form of a deformed part of the wall of the empty mouthpiece. Thus, the selective penetrability of the separating partition for the smoke is ensured by the availability of the clearance of the relevant size between the deformed and the non-deformed parts of the wall of the empty cigarette holder. In addition, or alternatively, the selective penetrability of the partition by the smoke, can be ensured by making the perforations of the relevant size in the deformed part of the wall of the empty mouthpiece.

As an alternative, the separating partition is selectively penetrable by the smoke and can be made in the form of perforated diaphragm installed in the cavity of the mouthpiece or in the cavity of the envelope of the casing of a Russian cigarette. The selective penetrability of the separating partition by the smoke is ensured by the perforations of suitable size.

Alternatively, the separating partition is selectively penetrable by the smoke and can be made in the form of a spiral insert installed in the cavity of the mouthpiece or in the cavity of the envelope of the casing of a Russian cigarette. In this case, the selective penetrability of the separating partition by the smoke is ensured by the clearance of the corresponding size between the convolutions.

The connection of the empty mouthpiece with the empty envelope in the casing of a Russian cigarette can be ensured, for example, by complete or partial overlapping of the mouthpiece by the envelope or their butted joint by means of the connection element.

Besides, it is expedient to install a spacing insert in the casing of a Russian cigarette in the part of the cavity of the envelope intended for the allocation of the smoking material. It will impede the deformation of this part of the envelope. This spacing insert is extracted before the allocation of the smoking material in the casing of a Russian cigarette.

For the purpose of increasing the stability of the composition of the smoke in the casing of a Russian cigarette, it is possible to manufacture the separating partition as selectively penetrable for the smoke and/or the mouthpiece of the material having low sorption capability.

Another object of this invention is a casing of a Russian cigarette having an empty mouthpiece and an empty envelope connected to it. This casing has a length of the mouthpiece that is at least equal to the length of the envelope, the envelope overlaps the mouthpiece with all its length, and the mouthpiece and the envelope are installed so that it is possible to move them relative to each other along the common longitudinal axis.

The length of the mouth piece is not less than the length of the envelope, and the mouthpiece is overlapped by all the length of the envelope and is used as a spacing insert impeding the deformation of the envelope, including that part of it which forms the cavity intended for the allocation of the smoking material. Installation of the mouthpiece and the envelope and providing the possibility of their mutual displacement along the common longitudinal axis makes it possible to form the cavity of the envelope as a result of this displacement. The cavity is intended for the allocation of the smoking material.

For the production of a Russian cigarette, the empty mouthpiece and the empty envelope are displaceable relative to each other along the common longitudinal axis. As a result, the envelope forms the cavity intended for the allocation of the smoking material. In this cavity, the smoking material is located and the resultant Russian cigarette may then be smoked.

The second object of this invention is achieved by management of well-known information about the physical properties of the materials used in the production of the casing of the so called Russian cigarettes.

The connection of the mouthpiece with the envelope is achieved by overlapping the mouthpiece by the envelope. The mouthpiece having a length at least equal to the length of the envelope, is overlapped by all the length of the envelope. The mouthpiece made of stiff mouthpiece paper resists the deformation of the envelope made of softer and more yielding cigarette paper. The mouthpiece and the envelope are installed so that it is possible to displace them relative to each other along the common longitudinal axis, leading to the formation of the cavity of the envelope intended for the allocation of the smoking material.

The casing of a Russian cigarette or like smoking device may contain a separating partition that is selectively penetrable by the smoke, installed so that it is possible to separate at least a part of the cavity of the mouthpiece from at least a part of the cavity of the envelope, and so that it is possible to overlap at least a part of the cross section of the cavity of the mouthpiece.

The separating partition is selectively penetrable by the smoke and may be made in the form of a deformed part of the wall of the mouthpiece. Besides, or alternatively, the selective penetrability of a partition for the smoke can be ensured by the perforations of suitable size.

Alternatively, the separating partition is selectively penetrable by the smoke and can be made in the form of a perforated diaphragm installed in the cavity of the mouthpiece or can be butt to it against the face of the mouthpiece.

As an option, the separating partition is selectively penetrable by the smoke and can be made in the form of a spiral insert installed in the cavity of the mouthpiece or can be butt to it against the face of the mouthpiece.

For the purpose of increase of the stability of the composition of the smoke in the casing of a Russian cigarette, it is possible to make a separating partition being selectively penetrable by the smoke and/or mouthpiece of the material having low sorption capability.

Alternatively, the casing of a Russian cigarette may incorporate any filter.

It is clear for those skilled in the art that any other additions and/or more accurate definitions of the inventive design are possible within the limits restricted by the subject of this invention.

BRIEF DESCRIPTION OF DRAWINGS

Features of this invention are explained, by way of example, in the detailed description of the design and practical application of the casing of Russian cigarettes with reference to the accompanying schematic drawings, wherein.

DETAILED DESCRIPTION OF THE INVENTION

Figure 1:
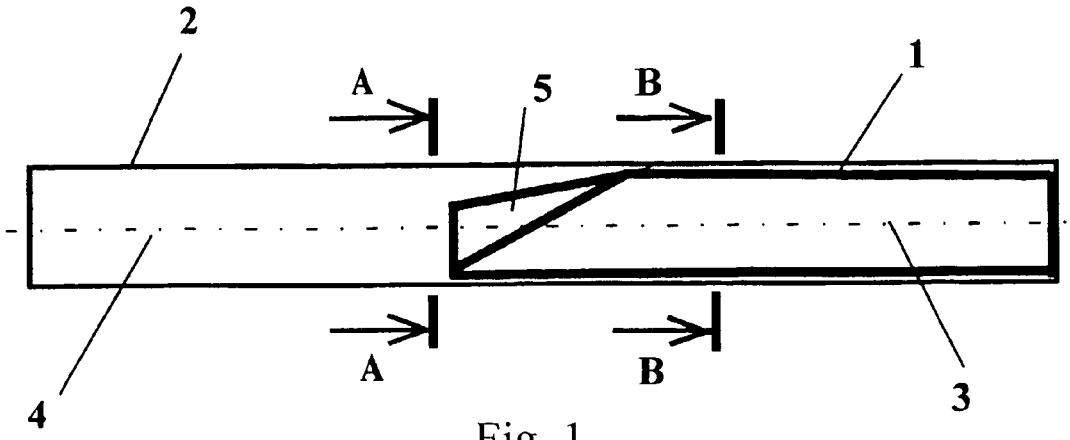
FIG. 1 is a schematic cross section view through the casing of a Russian cigarette or like smoking device according to this invention, in which the separating partition is selectively penetrable by the smoke and is made in the form of a deformed part of the wall of the empty mouthpiece, lengthwise section.
Figure 2:
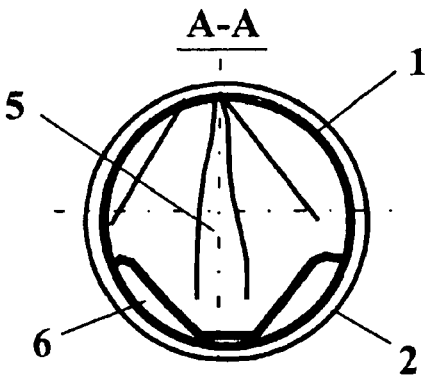
FIG. 2 is a section taken on the line A-A of FIG. 1.
Figure 3:
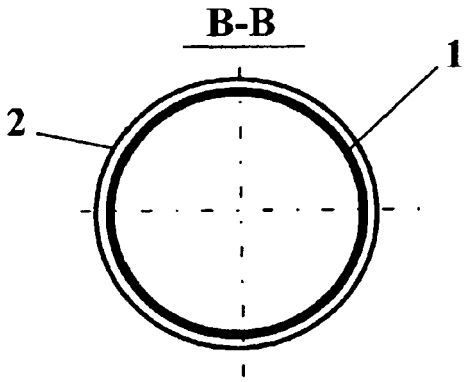
FIG. 3 is a section taken on the line B-B of FIG. 1.

Generally speaking, the casing of a Russian cigarette comprises an empty mouthpiece 1 and an empty envelope 2. Mouthpiece 1 is the support part of the casing.

Cavity 3 of the mouthpiece 1 is a channel for the passage of smoke during smoking. Cavity 4 of the envelope 2 is linked to the cavity 3 of the mouthpiece 1 and is intended for the allocation of the selected smoking material.

A separating partition which is selectively penetrable by the smoke from the direction of the cavity 4 of the envelope 2 (FIGS. 1, 2, 3, 4) and in the embodiment is provided by a deformed part 5 of the wall of the mouthpiece 1. There is a clearance 6 between the deformed part 5 of the wall of the mouthpiece 1 and non-deformed part of the wall of the mouthpiece 1, the size of which is sufficient for letting the smoke flow from the cavity 4 of the envelope 2 into the cavity 3 of the mouthpiece 1 during smoking. The deformed part 5 of the wall of the mouthpiece 1 may be perforated (FIG. 4), with the size of the perforations 7 being sufficient for the passage of smoke.

Figure 5:
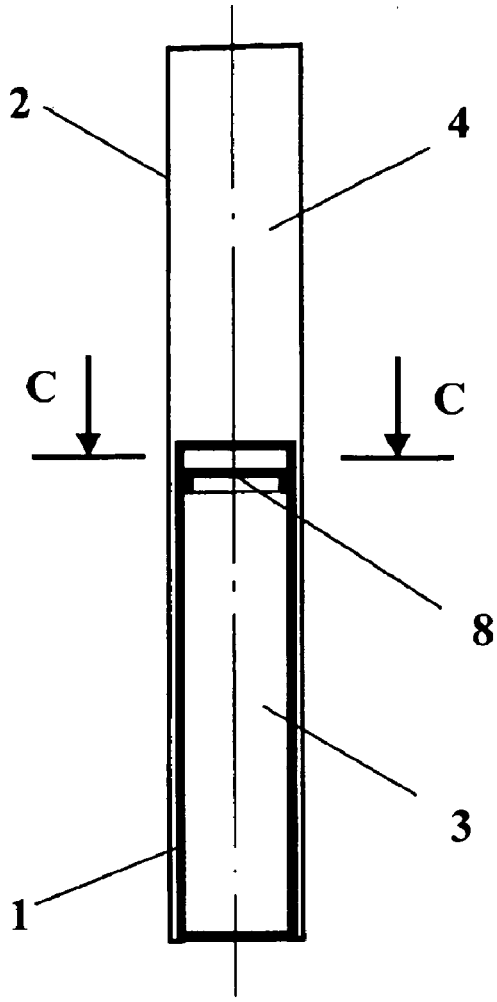
FIG. 5 is a longitudinal section taken through a casing forming an alternative embodiment of casing in which a separating partition is provided selectively penetrable by the smoke and in the form of a perforated diaphragm.
Figure 6:
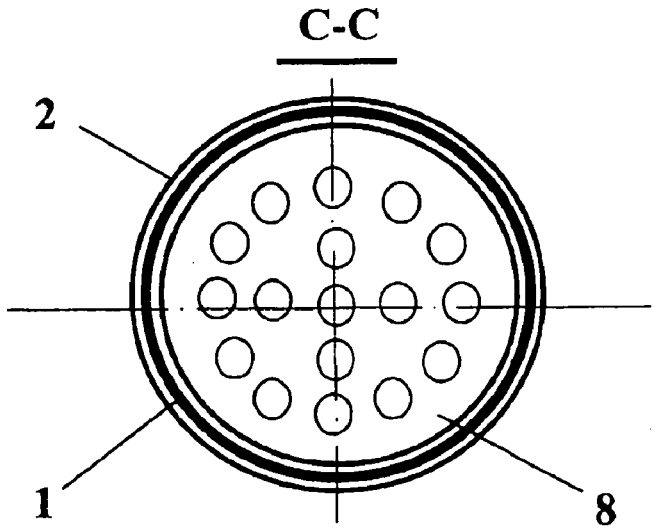
FIG. 6 is a section taken on the line C-C of FIG. 5.
Figure 7:
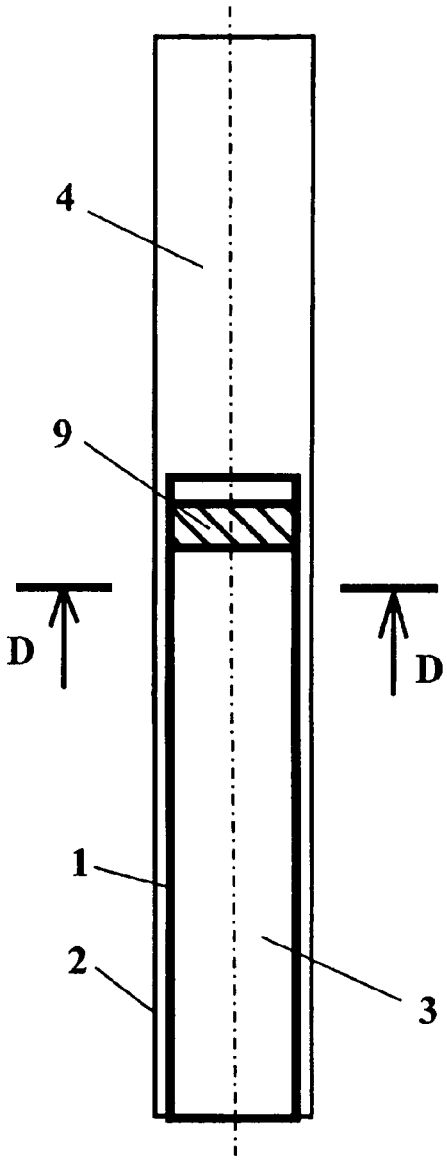
FIG. 7 is a longitudinal section taken through a casing forming an alternative embodiment of this invention in which the separating partition is selectively penetrable by the smoke and in the form of spiral insert.
Figure 8:
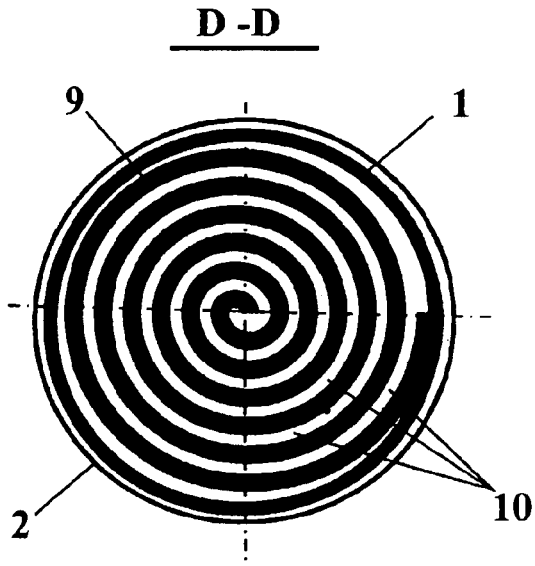
FIG. 8 is a section taken on the line D-D of FIG. 7.

The separating partition is selectively penetratable by smoking alternatively, and can be made in the form of a perforated diaphragm 8 installed in the cavity 3 of the mouthpiece 1 (FIGS. 5, 6). The separating partition being selectively penetrative by the smoke, may, alternatively, be made in the form of a spiral insert 9 installed in the cavity 3 of the mouthpiece 1 (FIGS. 7, 8). The spiral insert 9 has a clearance 10 the size of which is sufficient for letting in the smoke.

It is advantageous to manufacture the empty mouthpiece 1, perforated diaphragm 8 and spiral insert 9 of the same material using rather stiff mouthpiece paper. Such a material practically does not sorb the substances from the gaseous medium of the smoke and particles suspended in it. As a consequence, the above elements of the casing of the Russian cigarette made of the mouthpiece paper have almost no effect on the composition of the smoke of the smoking material.

Figure 9:
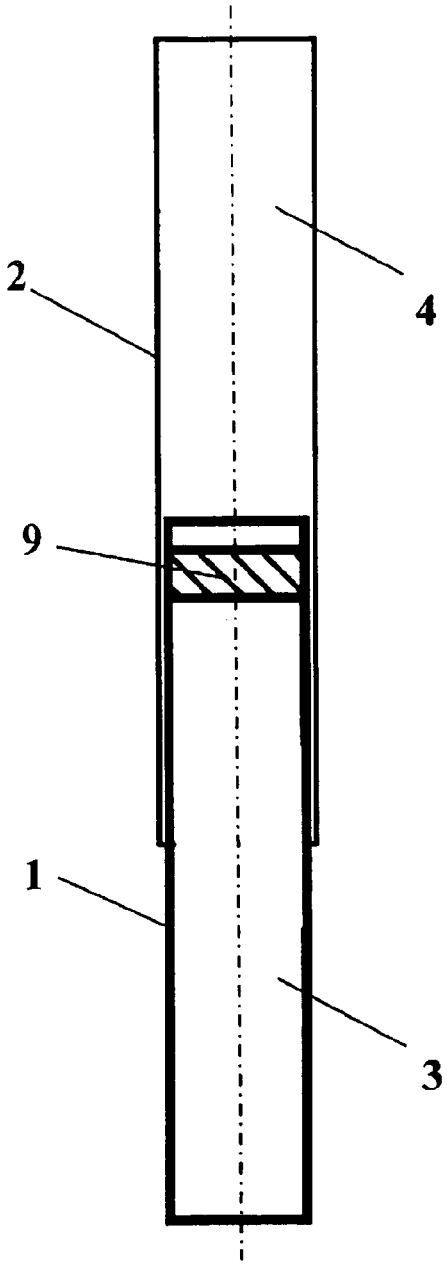
FIG. 9 is a longitudinal section taken through a casing forming a further embodiment of the casing according to this invention in which an empty mouthpiece is connected to an empty envelope by partial overlapping of the mouthpiece by the casing.
Figure 10:
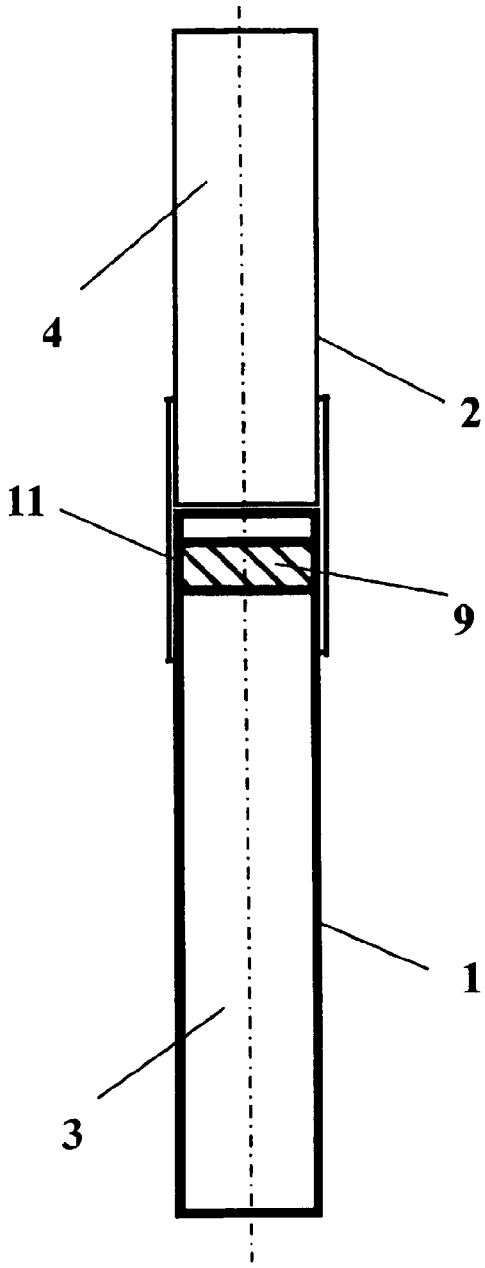
FIG. 10 is a longitudinal section taken through a casing forming an alternative embodiment of this invention, in which an empty mouthpiece is butt connected with an empty envelope by a connection element.

In any of the described embodiments of the casing of a Russian cigarette according to the invention, the connection of the empty mouthpiece 1 with the empty envelope 2 is ensured by the location of the empty mouthpiece 1 in the cavity of the envelope 2 with compete overlapping of the mouthpiece 1 by the envelope 2. Other possibilities for the connection are possible. Thus, it is possible to connect the empty mouthpiece 1 with the empty envelope 2 by the envelope 2 partially overlapping of the mouthpiece 1, as shown in FIG. 9. In this case, the empty envelope 2 tightly covers the empty mouthpiece 1 along its length partially. Butt connection of the empty mouthpiece 1 with the empty envelope 2 is also possible, such as by the connection element 11 (FIG. 10). In such a casing of Russian cigarettes according to this invention, the length of the cavity 4 of the empty envelope 2, intended for filling with the smoking material, are specified by the manufacturer beforehand.

Figure 11:
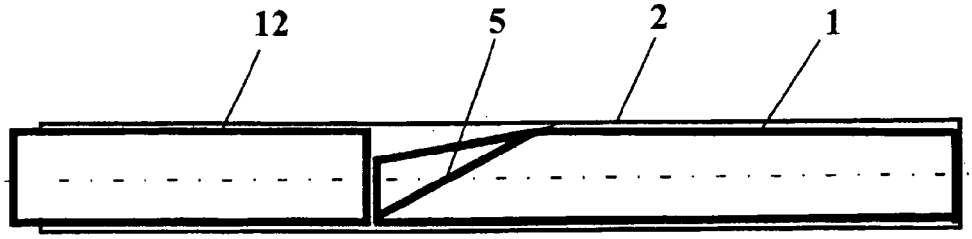
FIG. 11 is a longitudinal section taken through a still further embodiment of this invention with a spacing insert provided in the cavity of the envelope.

A spacing insert 12 (FIG. 11) for resisting the deformation of the cavity 4 of the envelope 2 during storage and transportation of the casing before the location of the smoking material may be installed in any of the mentioned embodiments, in the cavity 4 of the envelope 2 intended for filling with the smoking material.

Figure 4:
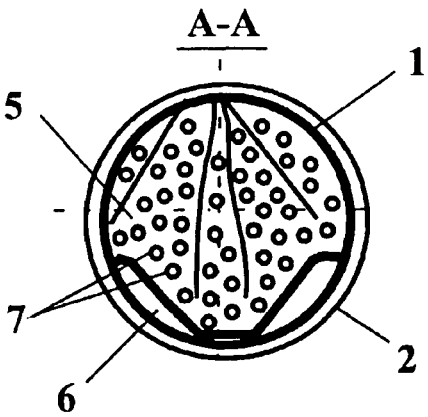
FIG. 4 is a section taken on the line A-A of FIG. 1, but wherein the deformed part of the wall of the empty mouthpiece is perforated.
Figure 12:
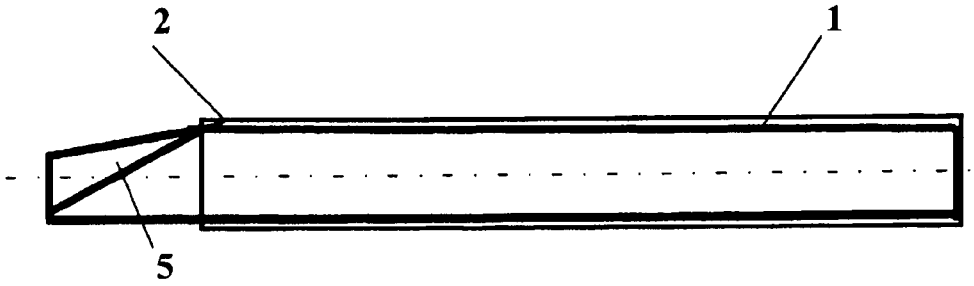
FIG. 12 is a longitudinal section of a further embodiment in which the length of an empty mouthpiece is not less than the length of an empty envelope, the envelope overlapping the mouthpiece by all the length, a part of the wall of the mouthpiece being deformed.
Figure 13:
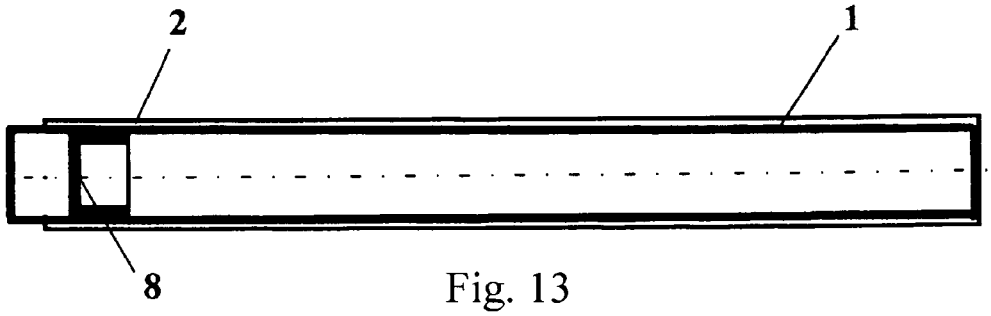
FIG. 13 is a longitudinal section of a further embodiment in which the length of an empty mouthpiece is not less than the length of an empty envelope, the envelope overlapping the mouthpiece by all length, and in the mouthpiece there is a separating partition for the smoke being selectively penetrable and made in the form of a perforated diaphragm.
Figure 14:
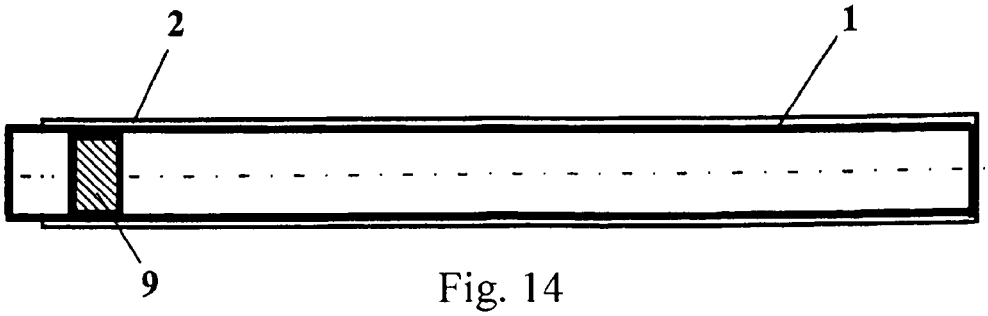
FIG. 14 is a longitudinal section of a casing forming a still further embodiment of this invention in which the length of the empty mouthpiece is not less than the length of the empty envelope, the envelope overlaps the mouthpiece by its entire length, and in the mouthpiece there is a separating partition being selectively penetrable for the smoke made in the form of a spiral insert, lengthwise section.

In one object of this invention, the casing of a Russian cigarette according to this invention, having an empty mouthpiece 1 and the empty envelope 2, the length of the mouthpiece 1 at least equals to the length of the envelope 2 (FIG. 12). Empty mouthpiece 1 and the empty envelope 2 are combined so that it is possible to move them relative to each other along the common longitudinal axis. The empty mouthpiece 1 may have a separating partition and can be selectively penetrable by the smoke, made in the form of the deformed part 5 of its wall (FIG. 12) which may be perforated (FIG. 4). The separating partition being selectively penetrative for the smoke, can be made in the form of the perforated diaphragm 8 (FIG. 13) or in the form of the spiral insert 9 (FIG. 14).

The method of use of such a casing of a Russian cigarette, according to this invention, is as follows. Before filling with the smoking material, a smoker moves the mouthpiece 1 and the envelope 2 relative to each other along the common longitudinal axis forming the cavity 4 of the envelope 2 intended for the allocation of the smoking material. The extent of the above travel can vary.

Such a design of the mouthpiece 1 ensures protection of the empty envelope 2 against deformation and damage during storage and transportation and prior to filling with smoking material and without application of any other additional elements. Besides, it allows independent adjustment of the size of the cavity 4 of the envelope 2 and consequently adjustment of the amount of the smoking material located by moving the empty mouthpiece 1 and the empty envelope 2.

Empty mouthpieces 1 are made by rolling appropriate sheet materials around the geometrical axis and overlapping such. The deformed part 5 of the wall of the mouthpiece 1 is formed individually on each mouthpiece 1. The perforations are made on the specified section before the rolling of the mouthpiece 1. The envelopes 2 are woundup on the mouthpieces 1 or manufactured separately and connected with the mouthpiece 1 by the connection element 11. The perforated diaphragms 8 are made by stamping either as a whole with the mouthpiece 1 before the rolling of the mouthpiece 1 or separately and are located in the cavity 3 of the mouthpiece 1 or in the cavity 4 of the envelope 2, butt against the mouthpiece 1.

The spiral inserts 9 are made by winding and cutting of the roll of the heavyweight paper or cardboard also as separate parts and then are located in the cavity 3 of the mouthpiece 1 or in the cavity 4 of the envelope 2, butt against the mouthpiece 1. The spacing inserts 12 are made by rolling the sheets of the heavyweight mouthpiece paper and are matched with the mouthpieces 1 before the winding of the envelopes 2.

Subsequently, the above casings of Russian cigarettes are assembled in complete sets, packed and transferred to a trading network.

Smokers fill the described casings of the Russian cigarettes with the selected of prescribed smoking material and use ready cigarettes as intended in the generally accepted way.

INDUSTRIAL APPLICABILITY

The casing of a Russian cigarette in any of the embodiments of this invention can be easily manufactured industrially. The Russian cigarettes manufactured by applying the casing of this invention provide the smokers with the convenience in use, hygiene and comfort of smoking thereby making it possible to preserve, almost completely, the desired taste and flavor of the tobacco smoke or medicinal factors of the smoke obtained from the smoking mixtures of the medical prescription.

The invention claimed is:

1. A casing of one of a cigarette and a smoking device, comprising: an empty mouthpiece (1) and one of a connected and a connectable empty envelope (2), the mouthpiece (1) within and detachable from the a cavity (4) of the envelope (2), at least a part of the cavity (4) of the envelope (2) able to receive smoking material, a separating partition selectively penetrable by smoke and installed in a second cavity (3) of the mouthpiece (1) at a position within the cavity (4) of the envelope (2), and overlapping at least a part of a cross section of the cavity (3) of the mouthpiece (1), the separating partition formed as a deformed part (5) of a wall of the empty mouthpiece (1), the deformed part (5) disposed at an end of the mouthpiece (1) within the cavity (4) of the envelope (2) and extending across the second cavity (3), the deformed part including a portion of an end edge of the mouthpiece contacting the opposing inner side wall of the second cavity (3), wherein clearances are formed on sides of the deformed part (5) between the deformed part (5) and the inner side wall of the second cavity (3).

2. The casing according to claim 1, wherein the deformed part (5) of the wall of the empty mouthpiece (1) is perforated (7).

3. A casing of one of a cigarette and a smoking device, comprising: an empty mouthpiece (1) and a connected empty envelope (2), the empty mouthpiece (1) formed of a material that is more rigid than a material forming the envelope (2), a length of the empty mouthpiece (1) being one of equal to and greater than a second length of the empty envelope (2), an entire length of the empty envelope (2) overlapping the empty mouthpiece (1), and the empty mouthpiece (1) and the empty envelope (2) displaceable relative to each other along a common longitudinal axis into a displaced configuration; and a separating partition disposed at a position within the mouthpiece (1) that is also within the envelope (2) both when the empty envelope (2) overlaps the empty mouthpiece (1) and is in the displaced configuration, the separating partition selectively penetrable by smoke and having a form of a perforated diaphragm (8) or a spiral insert (9) installed to overlap at least a partial cross section of a cavity (3) of the mouthpiece (1).

4. The casing according to claim 3, further comprising a filter.

5. The casing according to claim 1, wherein the empty mouthpiece (1) and the empty envelope (2) are moveable relative to each other along a common longitudinal axis.

6. The casing according to claim 1, wherein a removable spacing insert (12) is installed in a part of the cavity (4) of the envelope (2) during storage or shipping and removable prior to casing use.

7. The casing according to claim 1, wherein a separating partition is selectively penetrable by the smoke and is made of a material with a low sorption capability.

8. The casing according to claim 1, wherein the empty mouthpiece (1) and the empty envelope (2) are moveable relative to each other along a common longitudinal axis.

9. The casing according to claim 1, wherein a envelope (2) has a length greater than the mouthpiece (1), and further comprising a removable spacing insert (12) is installed in a part of the cavity (4) of the envelope (2) adjacent to the mouthpiece (1) during storage or shipping.

10. The casing according to claim 3, wherein a removable spacing insert (12) is installed in a part of the cavity (4) of the envelope (2).

11. The casing according to claim 10, wherein the empty mouthpiece (1) and the empty envelope (2) are moveable relative to each other along a common longitudinal axis.

* * * * *